United States Patent [19]

Allazzetta et al.

[11] Patent Number: 4,503,664

[45] Date of Patent: Mar. 12, 1985

[54] ROPE CHAIN MACHINE

[75] Inventors: Felice Allazzetta, Albiano; Luigi Prola, Borgofranco d'Ivrea, both of Italy

[73] Assignee: Morris Jaeger, Brooklyn, N.Y.

[21] Appl. No.: 458,970

[22] Filed: Jan. 18, 1983

[51] Int. Cl.[3] ..... B21L 11/00

[52] U.S. Cl. ..... 59/16; 59/25

[58] Field of Search ..... 59/16, 18, 24, 25, 1, 59/3, 10

[56] References Cited

U.S. PATENT DOCUMENTS

| | | | |
|---|---|---|---|
| 3,591,919 | 7/1971 | Cavagnero | 59/18 |
| 4,127,987 | 12/1978 | Tega et al. | 59/16 |
| 4,311,003 | 1/1982 | Tega | 59/25 |

*Primary Examiner*—W. D. Bray

*Attorney, Agent, or Firm*—Kane, Dalsimer, Kane, Sullivan and Kurucz

[57] ABSTRACT

A machine for making a chain in the form of a rope comprising a forming unit which is fed intermittently with wire by a feed device and is arranged to cut successive pieces of wire and form them into open rings on a movable conveyor pin, and a linking unit which is spaced from the forming unit and is arranged to receive the rings from the conveyor pin. The linking unit includes gripper means for taking the rings from the conveyor pin and introducing them to a final receiving and holding member in alternately overturned positions so that each of the rings embraces a plurality of preceding rings. The machine includes means for feeding the receiving and holding member with reinforcing wires for the chain. The machine also includes actuator means for controlling the supply of wire, the forming unit with the conveyor pin, and the gripper means of the linking unit in a predetermined operating sequence.

The forming unit further includes a device for squeezing together the axially opposed faces of the open rings formed on the conveyor pin.

16 Claims, 28 Drawing Figures

ROPE CHAIN MACHINE

BACKGROUND OF THE INVENTION

The present invention relates in general to the manufacture of metal chains which are valued by jewellers.

In particular, the invention concerns the making of a chain in the form of a rope constituted by a helical series of open rings each of which is interlinked with adjacent rings to define a configuration similar to a continuous double-stranded rope.

Given the extreme complexity of their formation, chains of this type have until now been made almost entirely by hand by particularly skilled and expert workmen. In particular, because of the usual extremely small size of these rings, the linking of the open rings requires great dexterity and manual agility, and continuous concentration on the part of the workman. Since the rings must be overturned alternately through 180° and simultaneously located so as to embrace a plurality of preceding rings, errors in the manual formation are far from infrequent. In any case, the production of these chains by hand involves long periods of time and consequently is very labor intensive and leads to a high selling price.

The general object of the present invention, therefore, is to provide a machine for making a chain in the form of a rope, with a completely automatic cycle.

A further object of the invention is to provide an automatic machine which can make a chain in the form of a rope directly from a continuous wire.

Another object of the invention is to provide an automatic machine based exclusively on mechanical parts which ensure safe and reliable operation.

A further object of the invention is to provide an automatic machine which is able to ensure a high production tempo and is totally free from errors in the formation of the rope chain.

SUMMARY OF THE INVENTION

These and other objects are achieved, according to the invention, by a machine having a frame which carries a device for feeding a wire along a feed path, a forming unit fed intermittently by the feed device and arranged to cut successive pieces of wire and form each of these pieces into a substantially circular open ring, a conveyor member for the rings, which is associated with the forming unit and is movable reciprocatingly along a conveying path, a linking unit spaced from the forming unit along the conveying path and arranged to receive the rings from the conveyor member, the linking unit including a final receiving and holding member and gripper means for taking the rings from the conveyor member and introducing and positioning the rings in the receiving and holding member in alternately overturned positions so that each of the rings embraces a plurality of preceding rings, means for feeding a reinforcement of wires to the receiving and holding member, and actuator means for operating the feed device, the forming unit with the conveyor member, and the gripper means of the linking unit in a predetermined operating sequence.

After the linked, reinforced chain exits the final receiving and holding member, a soldering operation will generally be undertaken in which a soldering compound is deposited between the links and melted to secure the links together. This type of soldering operation is well known in the art. The reinforcing wires may then be removed from the chain.

In the present invention, the linking unit of the rope chain machine automatically rotates alternate rings through 180° thereby engaging a plurality of preceding rings, which are held in the final receiving and holding member. This automatic 180° rotation represents a significant advance in the field of automatic chain manufacture.

BRIEF DESCRIPTION OF THE DRAWINGS

A preferred embodiment of the invention will be described below with reference to the appended drawings, provided purely by way of non-limiting example, in which.

DETAILED DESCRIPTION OF THE PREFERRED EMBODIMENT OF THE INVENTION

Figure 1:
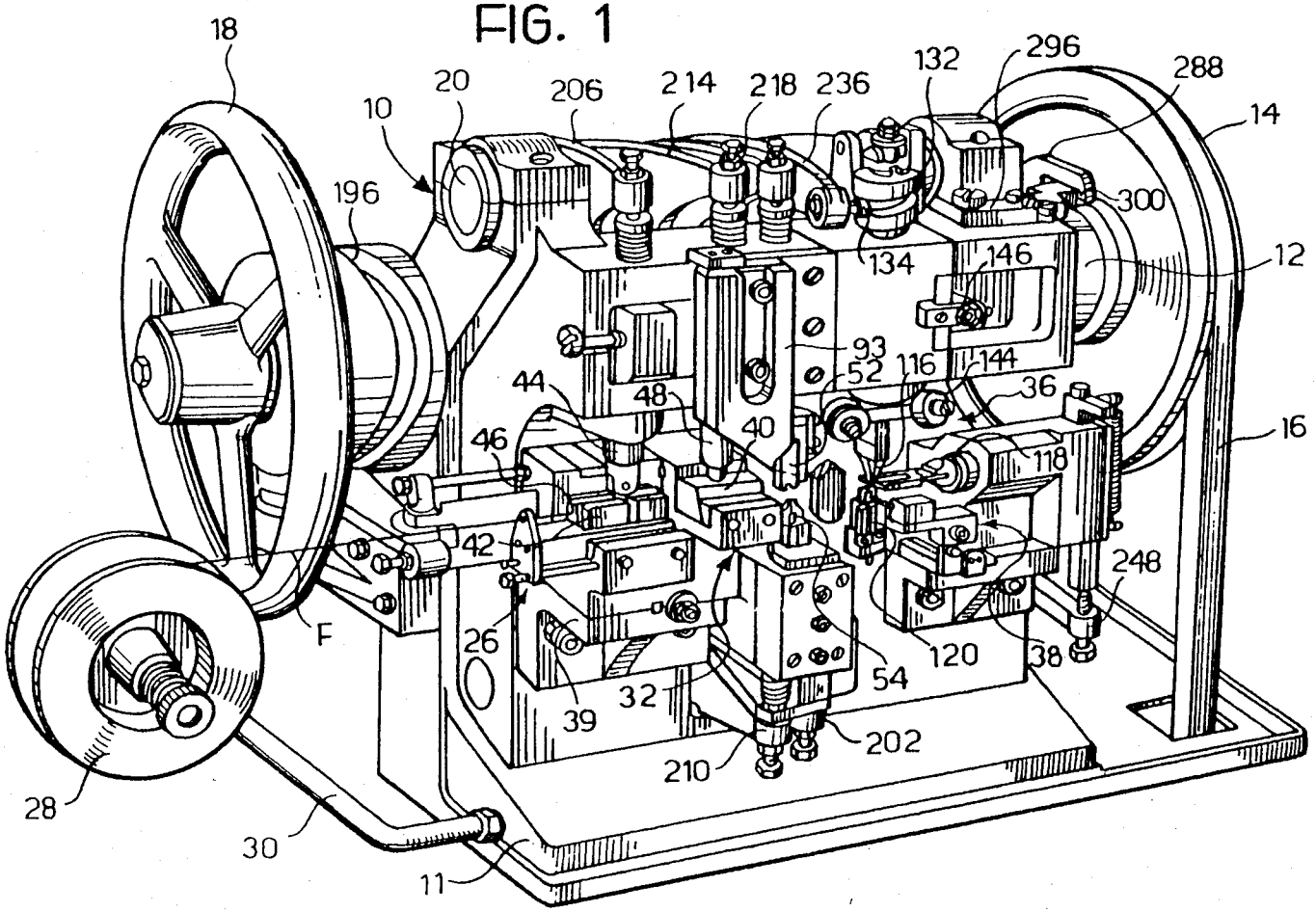
FIG. 1 is a schematic perspective view of a machine for making a chain in the form of a rope.

In the following description, the terms "upper" and "lower", "vertical" and "horizontal", "front" and "rear", and the like refer to the normal condition of the machine illustrated in FIG. 1 of the drawings.

Referring initially to FIGS. 1 to 4, the machine according to the invention includes a support frame, generally indicated 10, having a base-plate 11 at the bottom. The frame 10 supports rotatably a main horizontal camshaft 12 carrying a pulley 14 at one end, over which passes an endless belt 16 driven by an electric motor (not illustrated), and a fly wheel 18 at the other end. A support shaft 20 is fixed to the top of the frame 10 parallel to the main camshaft 12, and a secondary camshaft 22 is mounted rotatably in the right hand part of the frame 10, with reference to FIG. 1, between the main shaft 12 and the secondary shaft 20 and is parallel thereto. The secondary shaft 22 is rotated by the main shaft 12 through a gear transmission 24 with a transmission ratio of 1:2. Hence, for each complete revolution of the main shaft 12, the secondary shaft 22 rotates through half a revolution. The shafts 12 and 22 are arranged to drive various movable working parts of the machine, which are still to be described in the manner explained below.

On the front part of the frame 10 are arranged successively, starting from the left in FIG. 1, a feed device 26 for a wire F which is wound on a reel 28 supported by an arm 30 on the left-hand side of the base plate 11, a forming unit 32 including a squeezing device 34, and a final linking unit, generally indicated 36, including a safety device 38.

Figure 2:
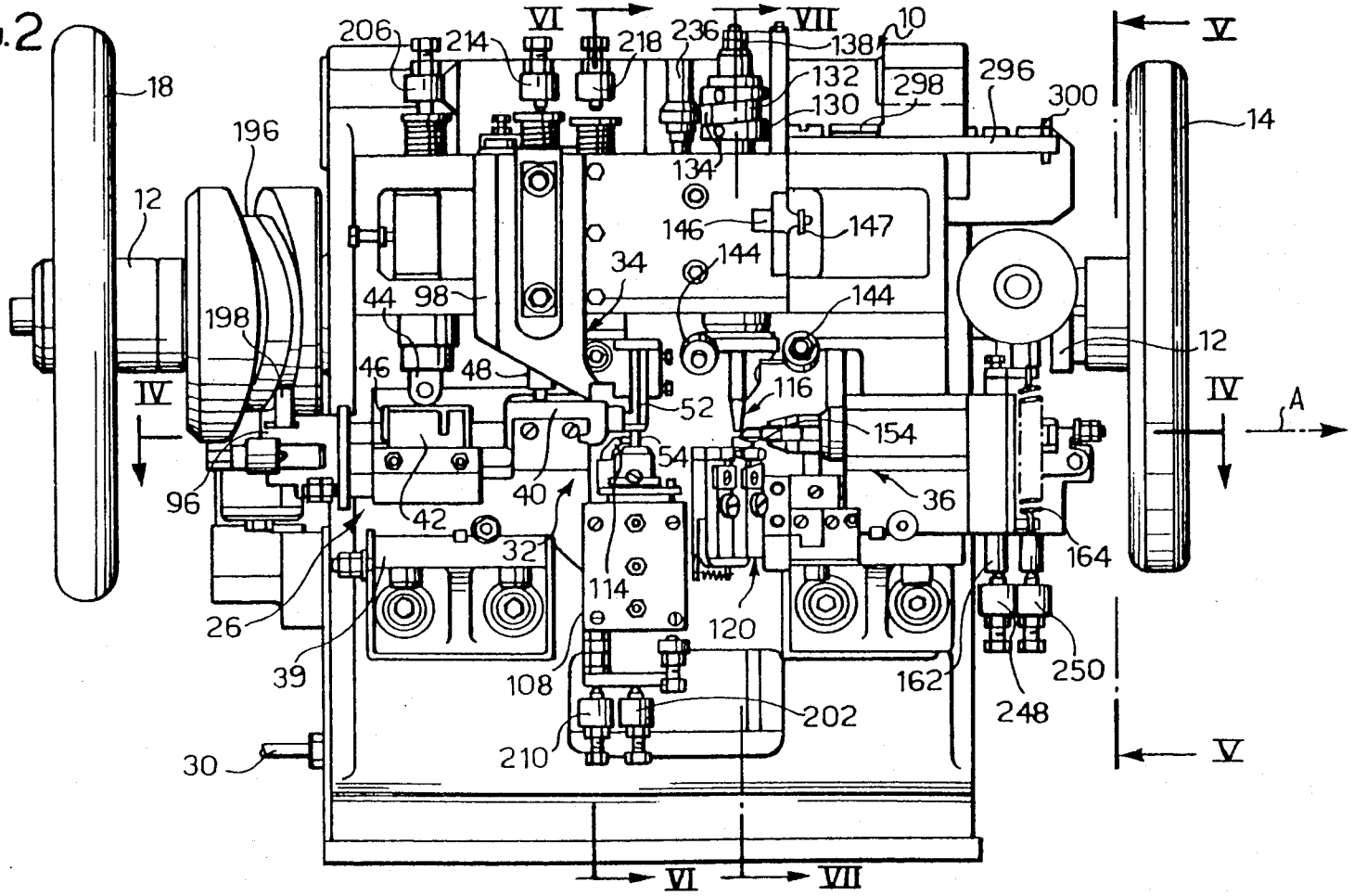
FIG. 2 is a front elevational view of FIG. 1.

Referring in greater detail to FIG. 1, the feed device 26 for the wire F includes a support part 39 which carries a fixed wire guide member 40 facing the forming unit 32, and a slider 42 which is movable backwards and forwards along the support part 39 in the direction indicated by the arrow A in FIG. 2, so as to reciprocate towards and away from the guide member 40. To the slider 42 is connected a vertically-movable push rod 44 which cooperates with a longitudinal wire presser plate 46 movable in the slider 42, while the wire guide member 40 is connected to a wire gripping device which includes a vertically movable wire gripper push rod 48. The push rod 44 and the wire presser plate 46 act in a manner which will be explained below, to lock the wire F relative to the slider 42 during its movement towards the wire guide member 40, while the wire gripper rod 48 acts to lock the wire F relative to the wire guide 40 during the return movements of the slider 42 controlling the feed of the wire F to the forming unit.

Figure 13:
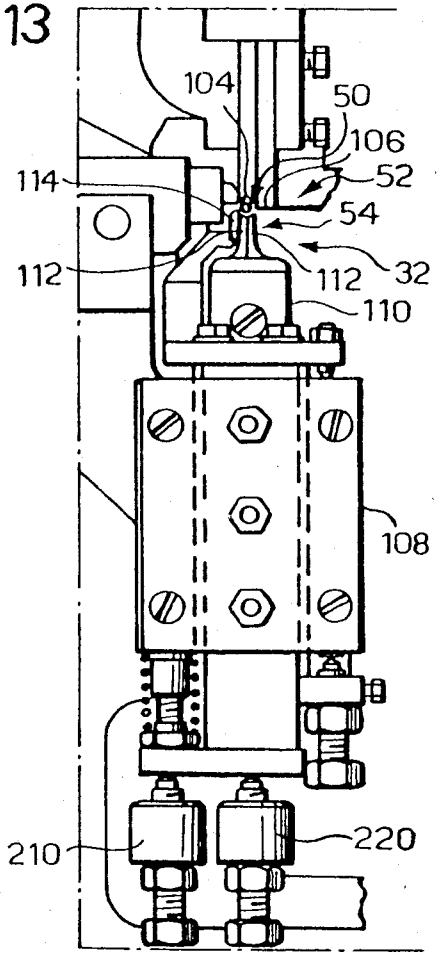
FIG. 13 is an elevational view illustrating a detail of FIG. 2 on an enlarged scale.

The forming unit 32 includes essentially, as illustrated in greater detail in FIG. 13, a forming pin 50 arranged horizontally and perpendicular to the direction of advance A of the wire F beneath the path thereof, a forming die 52 located vertically adjacent the wire guide member 40, and a pincer die 54 located beneath the forming die 52.

As is illustrated better in FIGS. 6, 8, 9, 11 and 12, the forming pin 50 is, in fact, constituted by a cylindrical rod 56 inserted through a tubular element 58 having a cylindrical part which defines a tubular punch 60 and is carried by a support member 62. The support member 62 is in turn supported by a body 64 so as to be slidable in a direction transverse to the direction of advance A of the wire F in order to allow forming pin 50 to move toward and away from tubular member 102. As is clearly illustrated in FIG. 8, a bushing 66 is fixed to the inner end of the rod 56 and is locked axially at 68 relative to a movable member 70 which is also slidably mounted in the body 64. A helical spring 72 inserted in a recess 74 in the support member 62 urges the element 70 against a facing projection 76 of member 62, thus maintaining the bushing 66 against the tubular element 58. The projection 76 has an adjustable stop screw 78 which bears against the body 64. It is clear, therefore, that the support member 62 with the tubular punch 60 is able to advance towards the right, with reference to FIG. 8, relative to the body 64, while the hollow element 70 with the rod 56 of the pin 50 is able to withdraw towards the left, still with reference to FIG. 8, relative to the support member 62 against the action of the spring 72. The advancement of the support member 62 is controlled by a vertical beating lever 80 which acts on the end of the hollow element 70 opposite the pin 50, while the withdrawal of the hollow element 70 is controlled by a horizontal lever 82 articulated at 84 to a movable assembly, generally indicated 87, to which the body 64 is fixed rigidly. The withdrawal lever 82 has a pin 86 arranged to engage an upper notch 88 in the hollow element 70. A tension spring 90 is interposed between the body 64 and the end of the withdrawal lever 82 carrying the pin 86.

Figure 4:
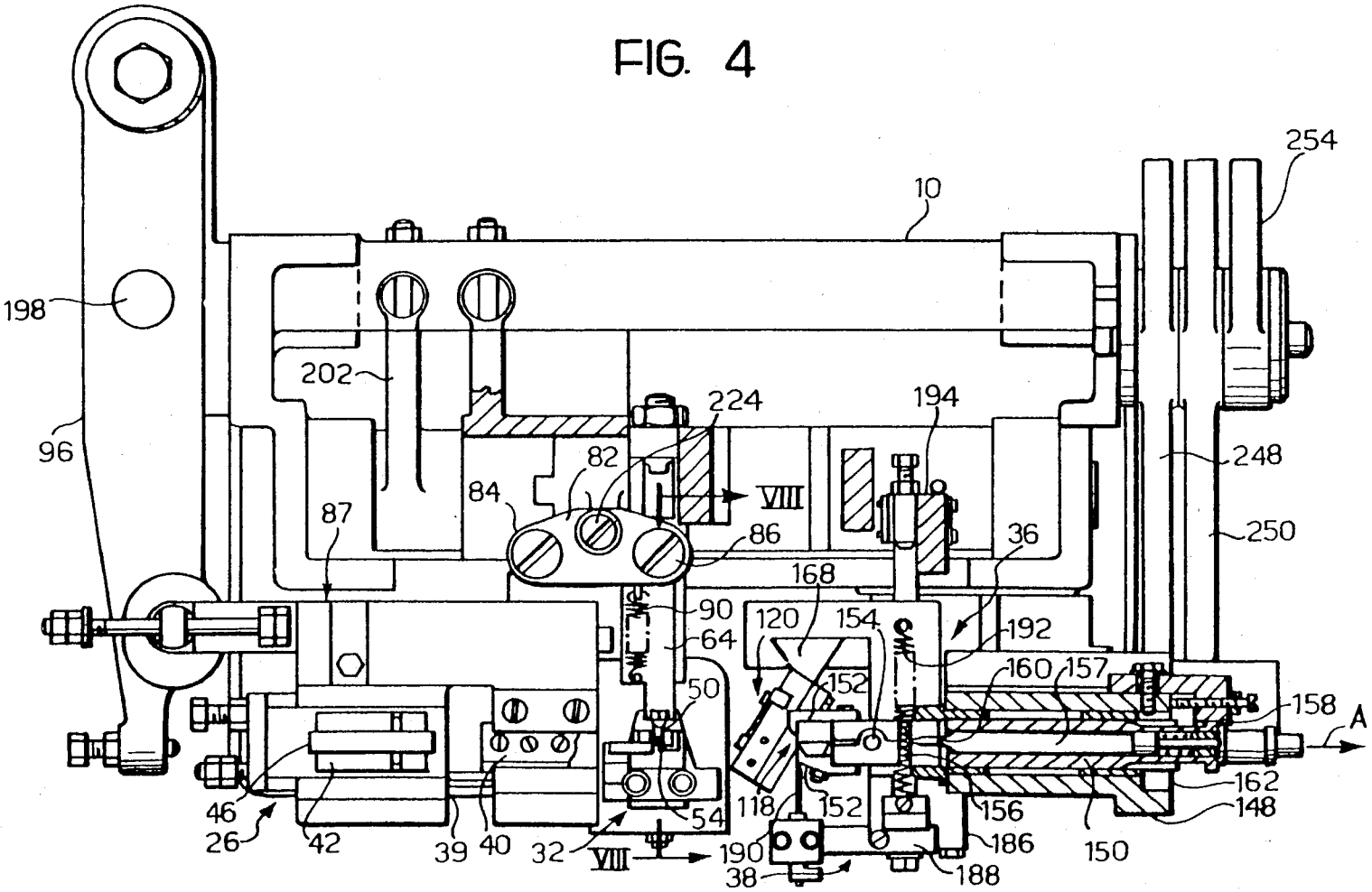
FIG. 4 is a horizontal partial sectional view taken along the line IV—IV of FIG. 2.

The movable assembly 87 includes a prismatic slider 92 which is mounted slidably in a corresponding horizontal prismatic guide in the frame 10 and carries, on its side opposite the forming pin 50, an attachment body 94 for connection to a pivoted control lever 96 (FIG. 4). By means of this control lever 96, the movable assembly 87 and hence the forming pin 50 are moved reciprocatingly in the direction of conveyance A, in the manner explained below, between a forming position in which the pin 50 is located in correspondence with the forming unit 32, that is, adjacent the feed device 26 for the wire F, and a delivery position in which this pin 50 is located in correspondence with the linking unit 36. At its forming position, the forming pin 50 cooperates with an anvil element, generally indicated 98 (FIG. 12), which includes a vertical support 100 fixed to the frame 10 and carrying at its lower end, a tubular member 102 (FIG. 8) which faces the pin 50 on the opposite side of the path of advancement A of the wire F, and is arranged to receive the rod 56 of pin 50, in the manner specified below.

Figure 14:
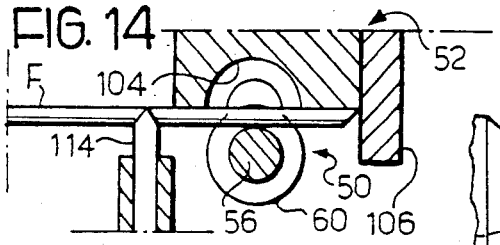
FIGS. 14 to 19 illustrate schematically various successive stages of operation of the forming unit of the machine.

Referring to FIGS. 13 and 14, the forming die 52 is constituted essentially by a vertical plate having at its lower end a substantially semi-circular recess 104, with a shape complementary to that of the rod 56 of the forming pin 50, followed by a striker 106 located on the opposite side of the recess 104 to the feed device 26. The forming die 52 cooperates with the forming pin 50 in the manner described blow, when the latter is located in the forming position. The forming die is displaceable vertically between a raised inoperative position in which its lower end is spaced from the rod 56, a first advanced holding position in which this lower end is adjacent the rod 56, and a second advanced forming position in which the recess 54 partially surrounds the rod 56.

Figure 6:
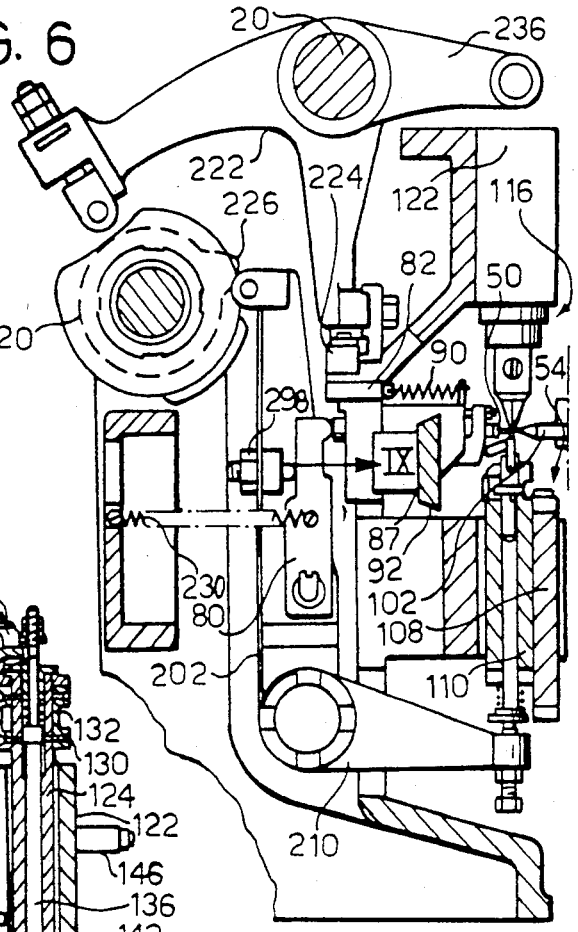
FIG. 6 is a vertical partial sectional view taken along the line VI—VI of FIG. 2.
Figure 15:
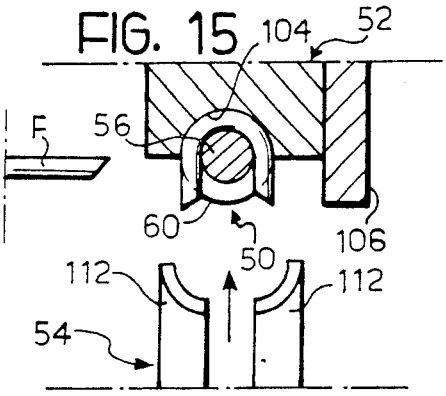

The pincer die 54, as illustrated in detail in FIGS. 6, 13 and 15, comprises a support body 108 (FIG. 13) in which is mounted slidably a prismatic member 110 carrying at its upper end, a pair of shaped arms 112 which are movable towards and away from each other. The two arms 112 are displaceable, in a manner which will be explained below, between a lowered open position in which they are spaced from the path of advancement A of the wire F, and a raised gripping position in which the arms 112 surround the rod 56 of the forming pin 50 on the side opposite the forming die 52.

A cutter 114 (FIG. 14) is associated with the pincer die 54 at the side of the arm 112 facing the feed device 26 for the wire F, and is also movable between a lowered inoperative position and a raised cutting position for cutting pieces of predetermined length from the wire F.

The linking unit 36 which as stated previously is spaced from the forming unit 32 along the path A, comprises essentially a vertical gripper 116, a horizontal gripper 118, and a final receiving and holding member 120.

Figure 7:
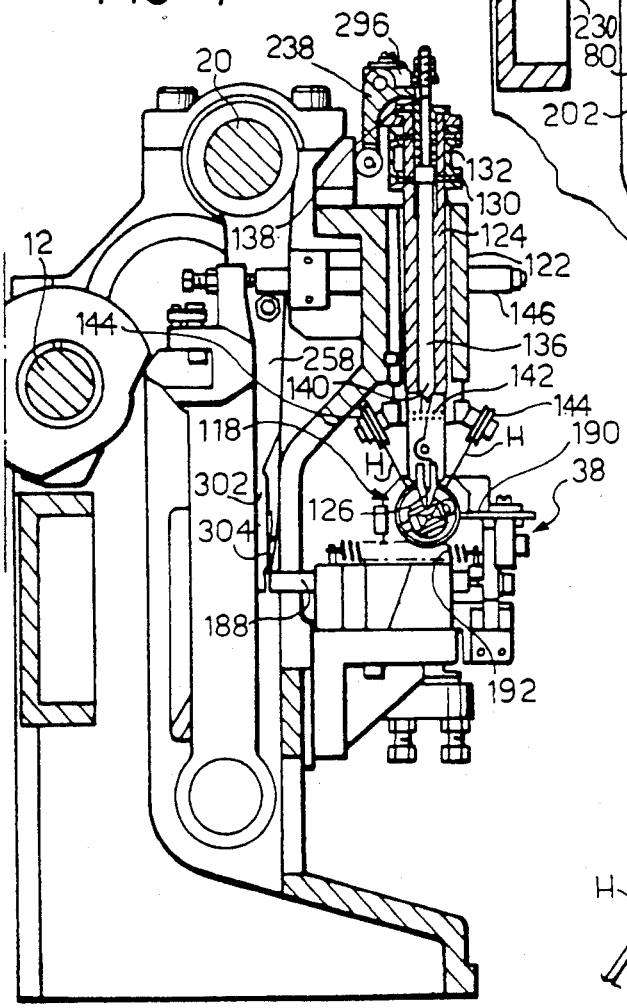
FIG. 7 is a vertical partial sectional view taken along the line VII—VII of FIG. 2.

Referring in more detail to FIGS. 6 and 7, the vertical gripper 116 comprises a tubular guide body 122 with a vertical axis, which is carried by the frame 10, and a hollow support member 124 mounted slidably and rotatably within the body 122. The member 124 carries at its lower end a pair of pointed gripping arms 126 which are articulated together at 128 and may be opened out. Member 124 is provided at its upper end with a collar 130 defining a substantially helical cam groove 132 in which is engaged a roller 134 carried by the frame 10 (FIG. 2). Within the support member 124 is mounted a rod 136 driven for axial sliding movement, as will be explained below, by a push rod 138 and having a lower wedge-shaped end 140 which normally holds the two arms 126 in the position in which they are close together. The raising of the rod 136 allows the two arms 126 to open under the action of a tension spring 142.

The support member 124 and hence the two arms 126 are displaceable vertically, in the manner described below, between a raised position spaced from the forming pin 50 (when the latter is in the delivery position in correspondence with the linking unit 36), and first, second and third successive advanced positions. Furthermore, the support member 124 and the two arms 126 are displaceable angularly about the direction of linear displacement, during the movement between the first and second and between the second and third advanced positions. When the vertical gripper 126 is in its raised position and in the first lowered position, the two arms 126 are aligned transversely to the direction of advance A of the wire F, that is, parallel to the rod 56 of the forming pin 50. On passing from the first advanced position to the second advanced position, the two arms 126 are rotated through 90° so as to be aligned parallel to the direction of advance A of the wire F. In subsequently passing from the second to the third advanced positions, the two arms 126 undergo a further rotation through 30°.

The rotation of the support member 124 and the arms 126 of the vertical gripper 116 is effected by a transverse rack 146 (FIGS. 2 and 7) driven in the manner explained below and to which a return spring 147 is connected.

Two inclined idle pulleys 144 are supported rotatably beneath the body 122 of the vertical gripper 116 on opposite sides from the two arms 126, and on these are wound, in a manner which will be described below, two reinforcing wires H which originate from respective reels (not illustrated) and converge towards the receiving and holding member 120.

Referring now in detail to FIG. 4, the horizontal gripper 118 includes a tubular guide body 148 carried by the frame 10 with its axis coincident with the direction of advance A of the wire F, that is, horizontally and perpendicular to the vertical gripper 116. A hollow member 150 is mounted rotatably in the guide body 148 and carries, at its end facing in the direction of the feed device 26, a pair of bent take-up arms 152 articulated together at 154 and normally held in an open position by a helical tension spring 156. The take-up arms 152 are located at the level of the arms 126 of the vertical gripper 116 when the latter are in the second lowered position. A rod 157 is slidable in the hollow member 150, being driven, as will be explained below, by an actuator, generally indicated 158, and has a wedge-shaped end 160 arranged to cause the opening of the two take-up arms 152. A rack 162 is provided for effecting, against the action of a return spring 164, the rotation of the hollow member 150 and hence of the two take-up arms 152 about the axis of the tubular member 148, usually through an angle of about 45°.

Figure 10:
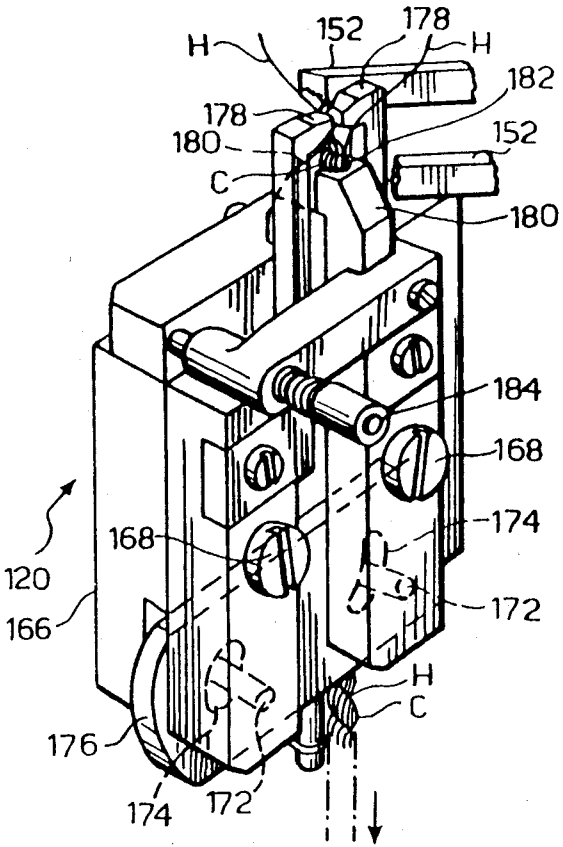
FIG. 10 is a perspective view of a detail of the linking unit of the machine on an enlarged scale.

FIG. 10 illustrates the receiving and holding member 120 in greater detail. This member 120 comprises essentially a generally parallelepiped-shaped support body 166 which is fixed to the frame 10 beneath the vertical gripper 116 by means of a bracket part 168 and is oriented so as to form an angle of 30° with the direction of advance A of the wire F. Two pivotable levers 170 (not illustrated) are articulated to the body 166 about respective pins 168 and carry at their lower ends transverse pins 172 slidable in eyelets 174 in a plate 176. At their upper ends, the two pivotable levers 170 carry two bent take-up arms 178 which project above the body 166 and are oriented like the latter, that is, at 30° to the direction of advance A. The two arms 178 can be moved apart against the action of a tension spring, not illustrated, and the fitting of the pins 172 in the eyelets 174 urges the pivotable levers 170 towards a vertical position, corresponding to a condition in which the two take-up arms 178 are brought close together.

Two shaped retaining arms 180 are also fitted into the body 166 beneath the two take-up arms 178, and define a tubular receiving passage 182 the width of which may be adjusted by means of a screw 184.

The safety device 38 of the forming unit 32 is connected to the receiving and holding member 120 and comprises essentially, as illustrated in greater detail in FIGS. 4 and 7, a bracket-shaped support part 186 which projects beneath the horizontal gripper 118 and on which is slidably mounted a support member 188 carrying a horizontal needle 190 which faces towards the receiving and holding member. 120 at a level between the take-up arms 178 and the retaining arms 180. The support 188 is subject to the action of a helical tension spring 192 which tends to pull it towards the frame 10, that is, towards a position in which the free end of the needle 190 extends immediately beneath the two take-up arms 178. An actuator, generally indicated 194, tends to hold the support 188 and hence the needle 190 in a withdrawn position against the action of the spring 192.

There will now be described in detail the various actuators of the machine, which drive the various components of the feed device 26, the forming unit 32, and the linking unit 36 in a predetermined operating sequence, and which are driven by the camshaft 12. These actuators generally comprise a series of rocker arms and pivoted levers provided with feelers cooperating with the cams of the shaft 12.

Figure 3:
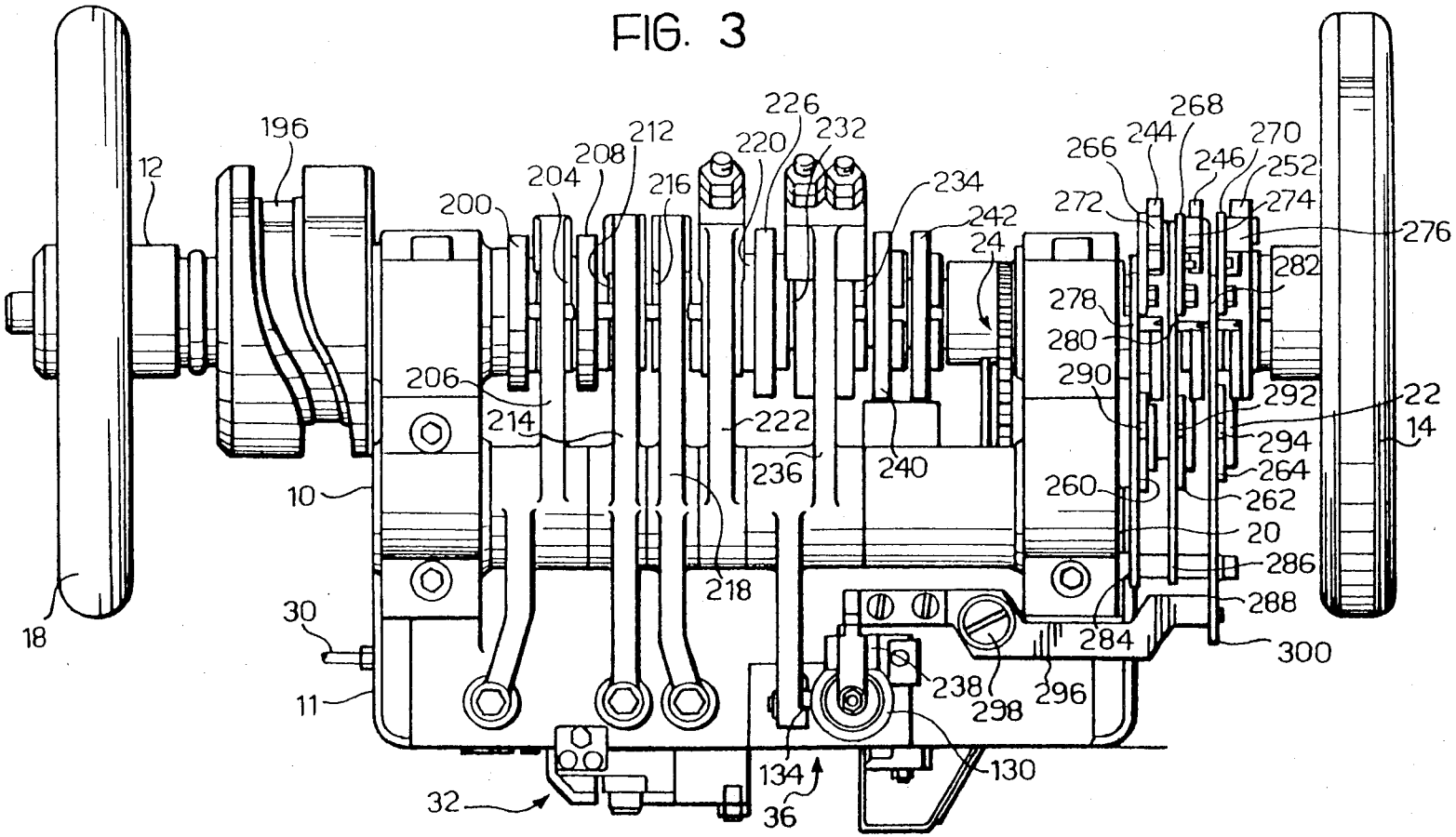
FIG. 3 is a plan view from above of FIG. 2.
Figure 5:
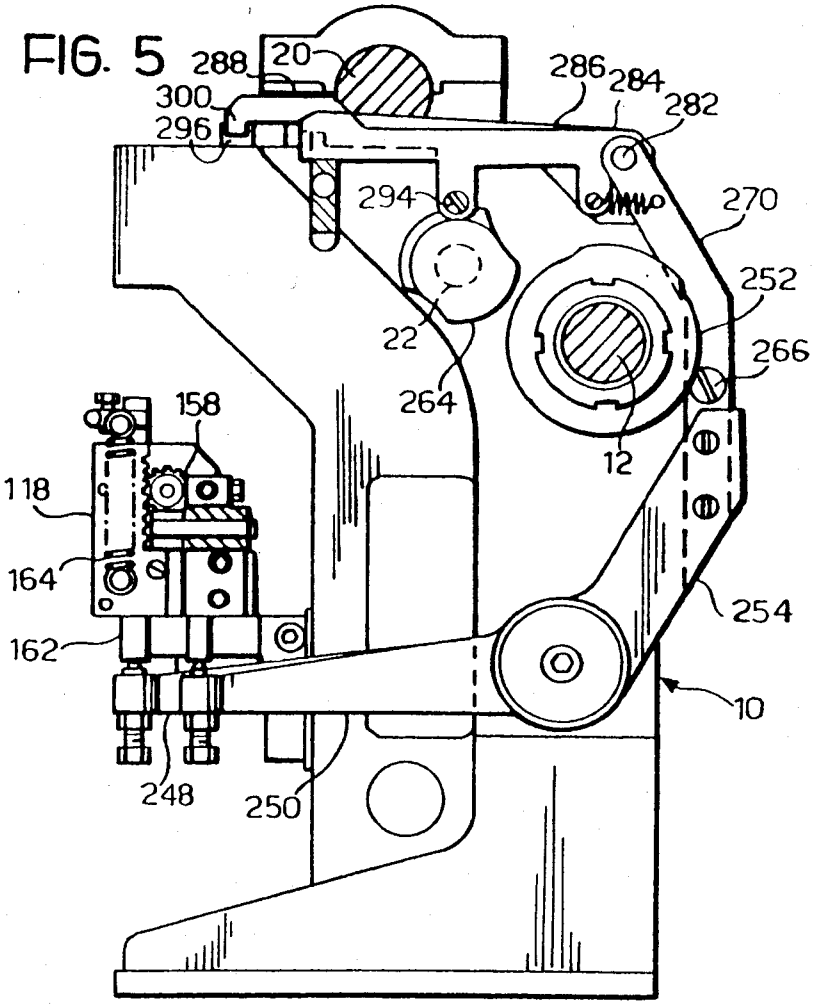
FIG. 5 is a vertical sectional view taken along the line V—V of FIG. 2.

Referring in particular to FIG. 3 and starting from the left in this Figure, the shaft 12 has:

a grooved cam 196 in which engages a feeler 198 carried by the pivoted lever 96 (FIG. 2) controlling the displacement of the movable assembly 87 of the forming pin 50 and the slider 42 of the feed device 26;

a first face (or tangential) cam 200 with which cooperates a pivoted lever 202 (FIGS. 4 and 6) for controlling the raising and closing and the lowering and opening of the pincer die 54;

a second face cam 204 for controlling the wire presser push rod 44 through a rocker arm 206;

a third face cam 208 for controlling the cutter 114 through a pivoted lever 120 (FIG. 13);

a fourth face cam 212 for controlling the wire gripping push rod 48 through a rocker arm 214;

a fifth face cam 216 for controlling the vertical movements of the forming die through a rocker arm 218;

a sixth face cam 220 which controls a rocker arm 222 cooperating with a feeler 224 (FIGS. 6, 9 and 12) carried by the withdrawal lever 82, for controlling the camshaft of the hollow element 70, and hence the rod 56 of the forming pin 50, relative to the tubular punch 60;

a seventh face cam 226 which controls the pivoting of the beating lever 80 through a push rod 228 (FIG. 6) against the action of a return spring 230, for effecting the advance of the support member 62 of the forming pin 50 relative to the body 64 in the direction of the anvil element 102;

an eighth face cam 232 which drives a rocker arm 236 carrying the feeler roller 134 engaged in the groove cam 132 of the vertical gripper 116, for controlling the lowering of the latter between the raised positon and the first lowered position;

a ninth face came 234 cooperating with a small pivoted lever 238 (FIGS. 2 and 7) for controlling the opening and closing of the take-up arms 126 of the vertical gripper 116 by means of the rod 136;

tenth and eleventh face cams 240, 242 for controlling the advance of the rack 146 in two successive strokes so as to achieve the initial rotation through 90° and the final rotation through a further 30° of the vertical gripper 116, and the simultaneous lowering of the latter from the first to the second and from the second to the third lowered positions by means of the cooperation between the grooved cam 132 and the feeler roller 134;

a twelfth face cam 244 and a thirteenth face cam 146 for controlling, through respective rocker arms 248, 250 (FIG. 5), the rotation of the horizontal gripper 118 through 45° by means of the translational movement of the rack 162, and the opening of the horizontal gripper 118 by means of the actuator 158 (FIG. 4) respectively, and a fourteenth face cam 252 for controlling the opening of the vertical gripper 116 by means of a pivoted lever 254 (FIGS. 4 and 5) when the vertical gripper is in the second lowered position, that is, after its rotation through 90° from the raised rest position.

The secondary shaft 22, which as stated previously is driven by the camshaft 12 through the pair of gears 24 with the transmission ratio of 1:2, is also provided with a plurality of face cams. Still referring to FIG. 3 and starting from the left of this Figure, the secondary shaft 22 has:

a first face cam 256 which controls the withdrawal of the support 188 of the safety needle 190 against the action of its spring 192 by means of a pivoted lever 258 (FIG. 7), and second, third, and fourth face cams 260, 262, 264 the respective functions of which are to prevent the rotation of the horizontal gripper 118, to close the horizontal gripper 118, and to open the vertical gripper 116 when it is in its second lowered position, at each second revolution of the camshaft 12. Indeed, as is clearly visible in FIGS. 3 and 5, the rocker arms 248, 250 and the pivoted lever 254 are connected rigidly to respective rods 266, 268, 270 provided with feeler rollers 272, 274, 276 which cooperate with the respective cams 244, 246, 252 of the shaft 12.

The rods 266, 268, 270 are, in their turn, articulated at 278, 280, 282 to respective levers 284, 286, 288 provided with feelers 290, 292, 294 which cooperate with the respective cams 260, 262, 264 of the secondary shaft 22. Thus, at each revolution of the secondary shaft 22, that is, every two revolutions of the main shaft 12, the levers 284, 286 space the rods 266, 268 from the cams 244, 246, preventing the rocker arms 248, 250 from pivoting so as to cancel respectively the rotation and the opening of the horizontal gripper 118. On the other hand, the raising of the lever 288 prevents the opening of the vertical gripper 116 when it is in its second lowered position, since this opening is normally effected by a horizontal rocker arm 296 articulated about a vertical pin 298 and connected to the lever 238 by means of which the rod 136 of the vertical gripper 116 is displaced. Under normal conditions, the rotation of the pivoted level 296, under the action of which the pivoted lever 238 operatively engages the push rod 138, is controlled by the withdrawal of the rod 288 which, as clearly shown in FIG. 5, has an engagement tooth 300 at its front end. When, however, the rod 288 is raised by the respective cam 264 of the secondary shaft 22, the tooth 300 disengages from the pivoted lever 296, making it impossible for the horizontal gripper 116 to open. The cam 264, as stated previously, is dimensioned so as to prevent the opening of the vertical gripper 116 every two revolutions of the main shaft 12 only when this vertical gripper 116 is in its second lowered position. It is possible, however, for the gripper 116 to open in any case as soon as it reaches the third advanced, position, following the further rotation through 30°.

The above-described operation of the various rocker arm levers or push rod actuators of the various movable members of the machine is, in general, of a common type and does not therefore require further explanation.

Figure 8:
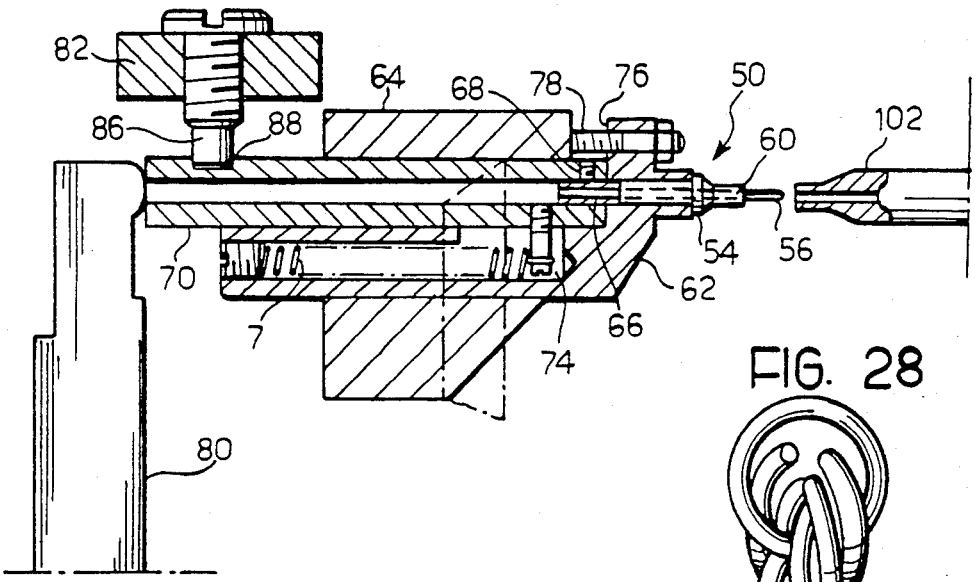
FIG. 8 is a sectional view on an enlarged scale taken along the line VIII—VIII of FIG. 4.
Figure 12:
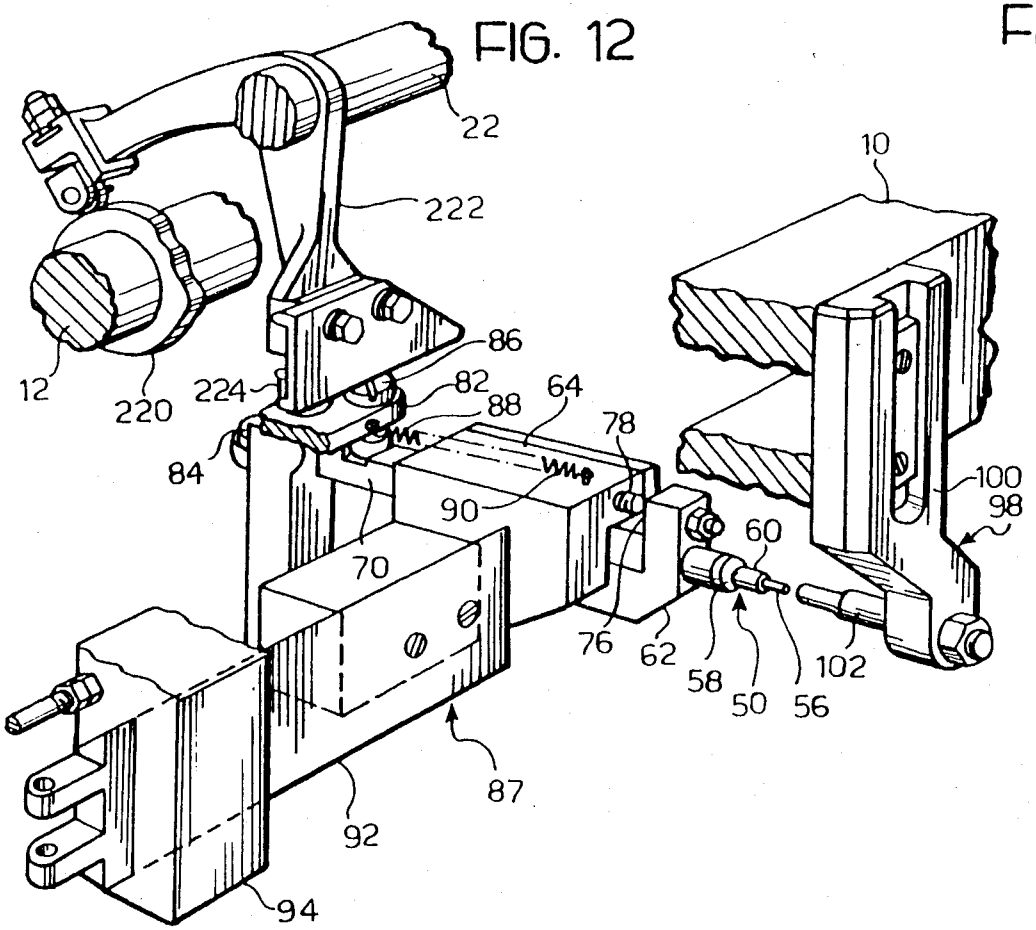
FIG. 12 is a partial perspective view illustrating a detail of the forming unit of the machine on an enlarged scale.

It should only be noted that the sixth face cam 220 which controls the withdrawal lever 82 of the forming pin 50 is shaped, as is best seen in FIG. 6, to effect a withdrawal cycle of the rod 56, starting from the advanced position illustrated in FIGS. 8 and 12, including a first partial withdrawal stage and a second subsequent total withdrawal stage, as will be explained below.

Finally, it should also be noted that a microswitch 302 connected in an electrical supply circuit for the machine is associated with the safety device 38 including the needle 190. The microswitch 302 is controlled by a blade 304 controlled, in its turn, by the movable member 188 when it advances under the action of its return spring 192 to bring the needle 190 into its working position. When this does not occur, because of any irregularities specified below, the non-actuation of the switch 302 stops the machine.

The operating cycle of the machine will now be described with particular reference to FIGS. 14 to 27.

Assuming a start from an initial condition in which the wire F is inserted in the feed device 26, the forming pin 50 is located in correspondence with the linking unit 36, the forming die 52 is in the raised rest position, the pincer die 56 is in the lowered open position, the cutter 114 is in the lowered position, and the linking unit 36 is in the rest condition, with the vertical gripper 116 in its raised position, the horizontal gripper 118 in its open rest position, and the safety device 38 withdrawn.

At the beginning of the cycle, the feed device 26 draws the wire F in the direction A towards the forming unit 32 by means of the slider 42 and the wire presser push rod 44. The wire F unwinds from the reel 28 and a section of this wire F of predetermined length passes through the forming unit 32, projecting horizontally from the wire guide member 40 above the path of the rod 56 of the forming pin 50. At this point, the wire gripper push rod 48 is actuated while the wire presser push rod 44 is deactivated, and the slider 42 is brought into its starting position while the forming pin 50 is brought simultaneously to the forming position, that is, in correspondence with the forming unit 32, with the rod 56 completely withdrawn immediately below the wire F.

The forming die 52 is then brought into its first lowered position (FIG. 14) so as to hold the section of wire F against the rod 56 of the pin 50 and allow this section of wire to be cut by raising the cutter 114.

Subsequently, the forming die 52 is brought into the second lowered position so as to deform the cut piece of wire F between the rod 56 and the recess 54. The piece of wire F thus takes on the configuration of an overturned U, as shown in FIG. 15.

Figure 16:
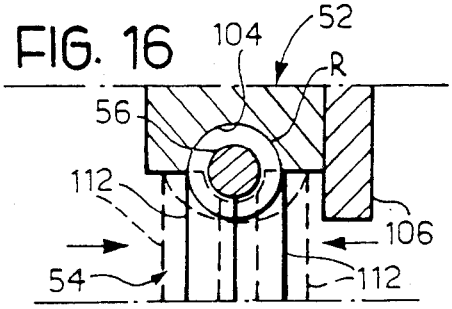
Figure 20:
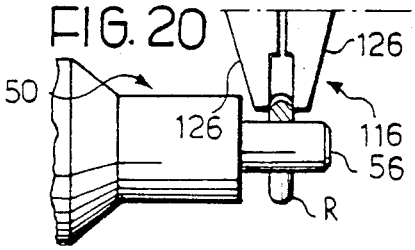

The pincer die is then raised to bring it into contact with the end of the piece of wire F and, at the same time, its shaped arms 112 close so as to wrap the piece completely around the rod 56 (FIG. 16).

The forming die 52 is brought into the raised position; while the pincer die 54 opens again and is simultaneously lowered.

Figure 18:
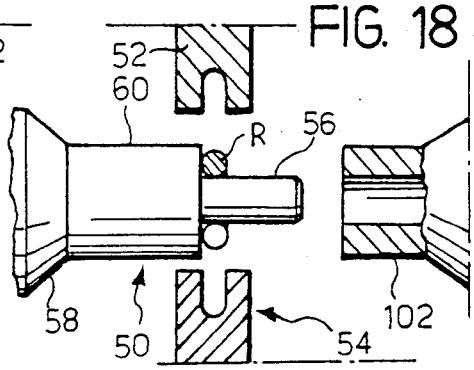
Figure 19:
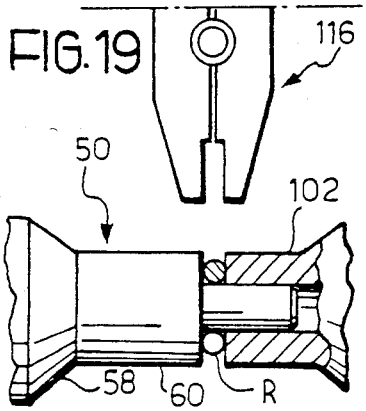
Figure 17:
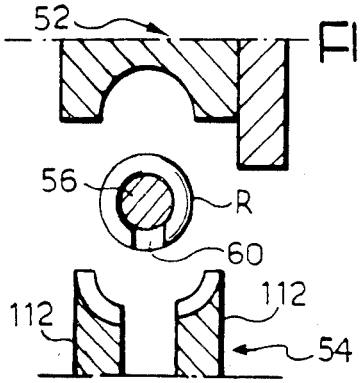

At the end of this stage, an open ring R is obtained, which is wrapped around the rod 56 of the forming pin 50 with its gap facing downwardly (FIGS. 17 and 18). At this point, the ring R is subjected to a lateral pressure to squeeze the axially opposed faces together. The squeezing operation initially causes the support member 62 and hence the pin 50 to come close to the anvil element 98 so as to insert the rod 56 of the forming pin 50 in the hollow member 102. At this stage, the beating lever 80 is made to oscillate sharply resulting in the ring R being squeezed between the facing front ends of the hollow member 102 and the tubular punch 60 (FIG. 19).

After this operation, the support member 62 moves away from the anvil element 98 until the stop screw 78 is brought into contact with the body 64. At this point, the rotation of the lever 82 causes a further withdrawal of the hollow member 70 and hence a partial withdrawal of the rod 56 from the tubular punch 60. Finally, the lever 82 brings rod 56 into the withdrawn starting position. The object of this operation is to space the ring R on the rod 56 from the front face of the tubular punch 60.

The stage of forming the ring R is thus concluded and the movable assembly 87 of the forming pin 50 is displaced towards the right into its delivery position, in correspondence with the linking unit 36, while the slider 42 of the feed device 26 again advances simultaneously towards the forming unit 32 carrying a new section of wire F thereto. At the end of the displacement of the forming pin 50, the vertical gripper 116 is lowered from its raised rest position to the first lowered position, with its take-up arms 126 in open positions on opposite sides of the upper part of the ring R on the rod 56. The two take-up arms 126 are closed on the ring R and, by means of the lever 82, the rod 56 is withdrawn completely and thus slides out of the ring R gripped by the vertical gripper 116. The movable assembly 87 carrying the forming pin 50 is then carried towards the left returning to its forming position in correspondence with the forming unit 32, in order to proceed to the preparation of the next ring R, while the preceding ring R is manipulated by the linking unit 36. This manipulation includes two different cycles by means of which the successive rings R coming from the forming unit 32 are inserted in the receiving and holding member 120 in alternately overturned positions, that is with the respective gaps facing downwardly and upwardly alternately.

At the beginning of the operating cycle of the machine, a first short length of rope chain must be manufactured apart from the automatic cycle which is about to begin, for instance by hand, and introduced within the receiving and holding member 120. The reinforcing wires H are then linked manually to the said first length of chain, and thereafter operation proceeds automatically.

Figure 21:
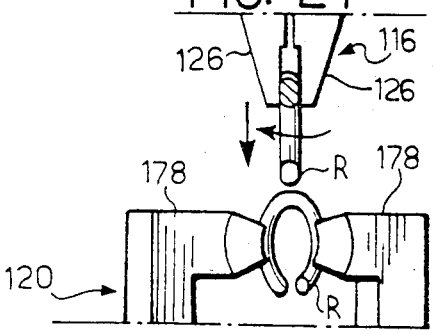
Figure 22:
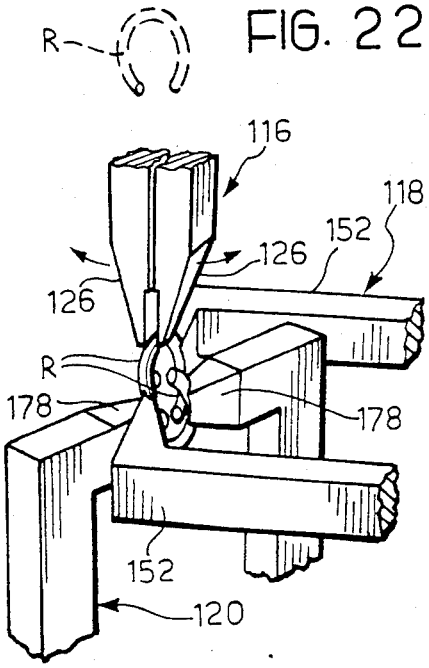

In the first type of ring manipulation to the receiving and holding member 120 the vertical gripper 116 is brought into the second lowered position while rotating through 90°, that is, to the level of the horizontal gripper 118. The disabling system described previously prevents the operation of this horizontal gripper 118 and the opening of the vertical gripper 116, and the latter (holding the ring R) is brought into the third lowered position while rotating through 30°. As a result of this movement, the ring R is inserted with its opening facing downwardly between the take-up arms 178 of the receiving and holding member 120 (FIG. 21). The ring R is then firmly clamped between the two arms 178. The vertical gripper 116 then opens and returns to the raised position to take-up the subsequent ring R.

Figure 23:
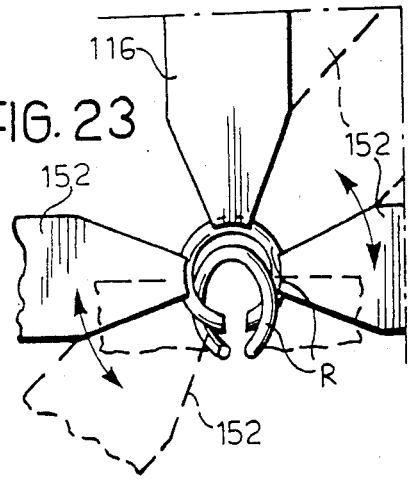
Figure 24:
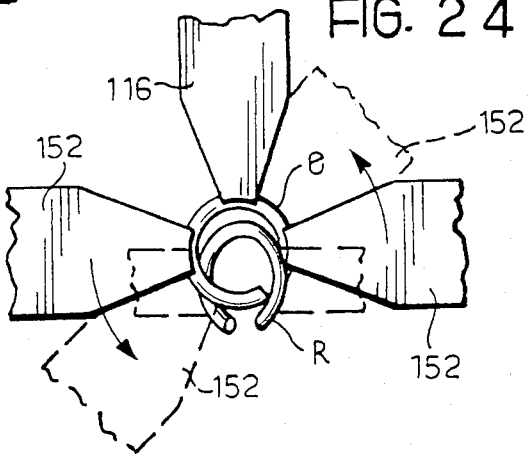
Figure 25:
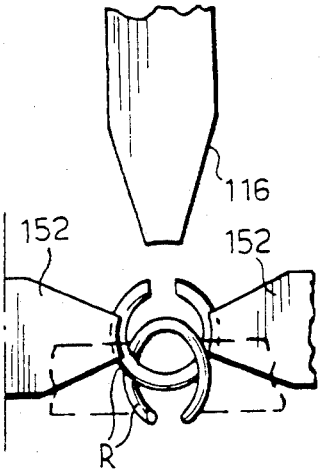

In the second case, that is, when the ring R must be delivered to the receiving and holding member 120 in an overturned position with the gap facing upwardly, the horizontal gripper 118 is operated as soon as the vertical gripper 116 reaches the second lowered position and embraces the preceding rings. First the take-up arms 152 close on the sides of ring R and then the arms 126 of the vertical gripper 116 open. At this point, the support member 150 of the horizontal gripper 118 undergoes a first rotation through 45° after which the vertical gripper 116 closes again, and the horizontal gripper 118 opens and is returned to its starting position. The horizontal gripper 118 closes again and the cycle continues in the same way until the ring R is in a position in which it has rotated through 180° relative to the starting position (FIGS. 23, 24 and 25).

Figure 26:
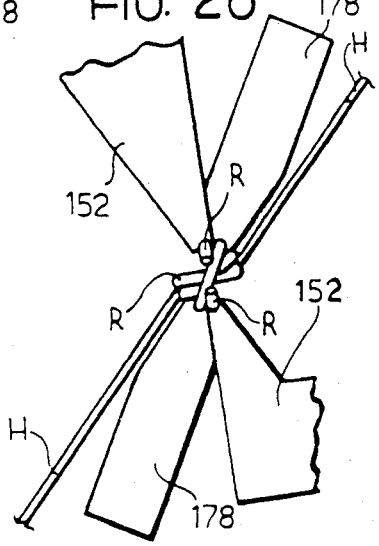
FIGS. 20 to 27 illustrate schematically various successive stages of operation of the linking unit of the machine.
Figure 27:
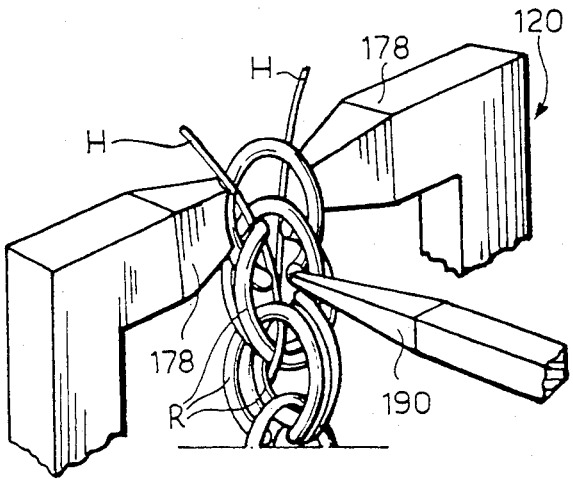

At the end of this operation, the vertical gripper 116 is brought into the third lowered position while rotating through 30°, so as to deliver the overturned ring R to the sprung arms 178 of the receiving and holding member 120. The preceding ring R with which the new overturned ring is engaged, is thus removed from the two arms 178 (FIGS. 26 and 27). The preceding ring R remains connected to the new ring R, however, due to the presence of the two reinforcing wires H from the two pulleys 144 and which in the stage of starting the machine must be linked manually to the first rings R produced and formed into the chain.

Figure 28:
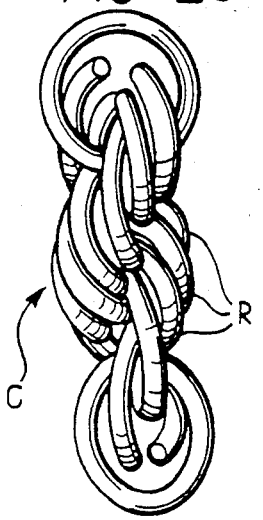
FIG. 28 is a perspective view of a piece of chain in the form of a rope produced by the machine according to the invention.
Figure 11:
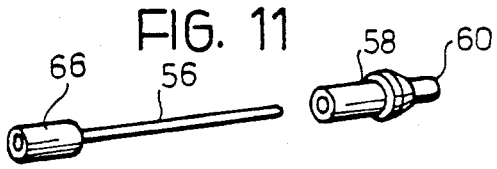
FIG. 11 is an exploded perspective view of a detail of FIG. 8.
Figure 9:
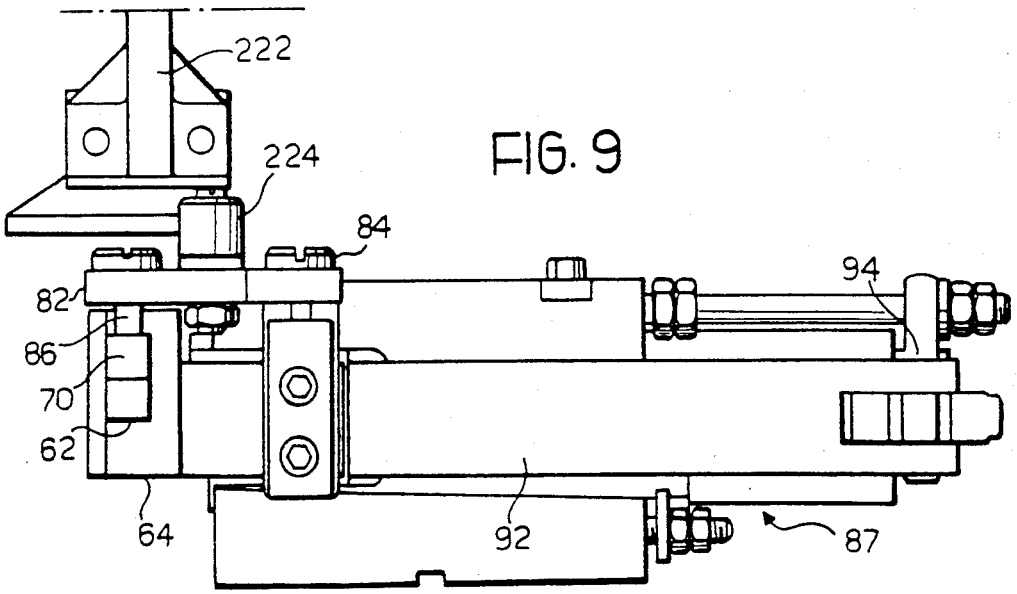
FIG. 9 is an elevational view on arrow IX of FIG. 6 on an enlarged scale.

The production cycle is repeated in the same way so as to form a continuous rope chain, indicated by C in FIG. 28, which is formed by a helical series of alternately overturned open rings R each of which embraces a plurality of the preceding rings R. After the formation of the first portion of chain C, the reinforcing wires H from the pulleys 144 are drawn automatically by the chain and twist themselves around the chain due to the helical movement of the rings R which occurs at the moment of their delivery to the receiving and holding member 120. The chain C is formed beneath the holding arms 178 and is forced into the passage 182 defined by the two arms 180 of the member 120, which thus acts as a die to ensure the correct retention of the successively linked rings R. As is seen in FIG. 10, the chain C formed with its respective reinforcing wires H hangs beneath the member 120, and may be collected in suitable containers to be subsequently cut into pieces of predetermined length and subjected to subsequent conventional treatments of welding between the pairs of adjacent rings R.

As explained above, the safety needle 190 acts at every second rotation of the camshaft 12 and is arranged to check the correct positioning of the rings R with upwardly facing gaps. The needle 190 passes through the gaps of these rings, also removing any burrs on the edges of the gaps which may prevent the correct passage to the next ring. As explained above, in the case in which the passage of the safety needle 190 is prevented in some way, the switch 302 immediately stops the machine for the necessary checking.

What is claimed is:

1. A machine for making a chain of rings, comprising:

feed means for feeding a wire along a feed path, a forming means for receiving the wire, cutting pieces therefrom and forming each piece of wire into a substantially circular open ring, a linking means for receiving each open ring and coupling it with at least one preceding ring, ring turning means for turning the open ring relative to the preceding ring prior to coupling and reinforcement wire feed means for feeding a reinforcement wire within each ring as it is coupled with the preceding ring to maintain the integrity of the chain as it is being made.

2. The invention in accordance with claim 1, in which the linking means further comprises control means for checking the correct positioning of the open rings, the control means having a safety device for effecting an automatic stoppage of the actuator means in the event of an error in the positioning of the open rings.

3. A machine in accordance with claim 1, wherein the actuator means comprises a driven camshaft and a series of movable actuators cooperating with the cams of said shaft.

4. The invention in accordance with claim 3, wherein the machine operates on a completely automatic cycle.

5. A machine for making a chain in the form of a rope constituted by a helical series of open rings so as to define a configuration similar to a continuous double stranded rope, comprising:

a device for feeding a wire along a feed path;

a forming unit arranged to receive the wire, to cut the wire, and to form pieces of the wire into a substantially circular open ring;

a linking unit arranged to receive the open ring formed by the forming unit and couple it with a plurality of preceding rings; and actuator means for operating the feed device, the forming unit and the gripper means of the linking unit in a predetermined operating sequence.

6. The machine in accordance with claim 5, wherein the linking unit further comprises a means for feeding a reinforcement of wires to a receiving and holding member in the linking unit.

7. A machine for making a chain in the form of a rope constituted by a helical series of open rings each of which is interlinked with adjacent rings so as to define a configuration similar to a continuous double-stranded rope, comprising:

a frame which carries a device for feeding a wire along a feed path;

a forming unit fed intermittently by the feed device and arranged to cut successive pieces of wire and form each of these pieces into a substantially circular open ring;

a conveyor member for the rings, which is associated with the forming unit and is movable reciprocatingly along a conveying path;

a linking unit spaced from the forming unit along the conveying path and arranged to receive from the conveyor member the open rings formed by the forming unit, the linking unit including a final receiving and holding member and gripper means for taking the rings from the conveyor member and introducing and positioning the rings in the receiving and holding member in alternately overturned positions so that each of the rings embraces a plurality of preceding rings;

means for feeding a reinforcement of wires to the receiving and holding member; and actuator means for operating the feed device, the forming unit with the conveyor member, and the gripper means of the linking unit in a predetermined operating sequence.

8. A machine in accordance with claim 7, in which the forming unit further comprises a device for squeezing together the axially opposed faces of the open rings formed by the forming unit.

9. A machine in accordance with claim 7, in which the linking unit further comprises control means associated with the receiving and holding member for checking the correct insertion and positioning of the open rings in the receiving and holding member, the control means including a safety device for effecting an automatic stoppage of the actuator means in the event of an error in the insertion and/or positioning of the open rings.

10. A machine in accordance with claim 8, in which the forming unit further comprises:

a forming pin for the rings which is arranged transversely immediately below the feed path of the wire and constitutes said conveyor member;

drive means for displacing the forming pin axially between an advanced position and at least one withdrawn position, and for reciprocating the pin along the conveying path between a forming position in which it is located in correspondence with the forming unit, and a delivery position in which it is located in correspondence with the linking unit;

a forming die located above the feed path for the wire and having a recess complementary with part of the forming pin;

drive means for displacing the forming die transversely of the feed direction of the wire between a withdrawn inoperative position in which it is spaced from the feed path, a first advanced retaining position in which it is adjacent the feed path, and a second advanced forming position in which the recess partially embraces the forming pin when the latter is in the forming position and in the advanced position;

a cutter located beneath the feed path for the wire;

drive means for displacing the cutter parallel to the direction of displacement of the forming die between a withdrawn rest position and an advanced cutting position for cutting a piece of predetermined length from the wire when the forming pin is in the forming position and the forming die is in the first advanced position;

a pincer die located on the opposite side of the feed path of the wire from the forming die, and drive means for displacing the pincer die in the direction of displacement of the forming die between a withdrawn open position in which it is spaced from the feed path of the wire, and an advanced gripping position in which it partially embraces the forming pin on the opposite side to the forming die when the latter is in its second advanced position.

11. A machine in accordance with claim 10, in which the squeezing device includes an anvil element having a tubular member engageable axially by the forming pin when the latter is in the forming position, a tubular punch slidable coaxially relative to the forming pin, and drive means for engaging the forming pin in the tubular punch close to and facing the tubular member of the anvil element.

12. A machine in accordance with claim 7, in which the linking unit includes:

first gripper means aligned with the receiving and holding member and arranged transversely to the conveying path of the conveyor member on the opposite side thereof to the receiving and holding member;

first drive means for displacing the first gripper means linearly relative to the conveyor path between a withdrawn position, a first advanced position for taking up the rings from the conveyor member, and at least one second advanced position for delivering the rings to the receiving and holding member, and for angularly displacing the first gripper means about the direction of linear displacement during the movement between the first and the second advanced positions;

second drive means for effecting the opening and closing movements of first gripper means;

second gripper means extending in a direction transverse the first gripper means and the receiving and holding member across the path of linear displacement of the first gripper means, for cooperating with the first gripper means when the latter are in the second advanced position;

first drive means for the second gripper means for effecting their opening and closing movements;

second drive means for the second gripper means for angularly displacing the second gripper means about the transverse direction in the closed condition of the second gripper means, and disabling means for selectively disabling the first and second drive means of the second gripper means.

13. A machine in accordance with claim 7, in which the actuator means comprises a driven camshaft and a series of movable actuators cooperating with the cams of said shaft.

14. A machine in accordance with claim 13, in which the actuator means further include a secondary camshaft and a series of actuator levers associated with the disabling means and cooperating with the cams of the secondary shaft.

15. A method of making a chain from open rings comprising the steps of:

feeding a wire along a feed path;

cutting pieces of predetermined length from the wire;

forming each piece of wire into a substantially circular open ring;

coupling each open ring with at least one preceding ring;

orienting the open ring in a predetermined fashion relative to the preceding ring; and feeding a reinforcement wire interiorly of each open ring in facilitating the making of the chain.

16. The invention in accordance with claim 15, including the step of; soldering each open ring to the preceding ring to secure it to the preceding ring.

* * * * *